US006254088B1

(12) United States Patent
Kramer et al.

(10) Patent No.: US 6,254,088 B1
(45) Date of Patent: Jul. 3, 2001

(54) METHOD OF MANUFACTURING PRINTED PRODUCTS BY INSETTING AT LEAST ONE SUBPRODUCT INTO A MAIN PRODUCT AND APPARATUS FOR CARRYING OUT THE METHOD

(75) Inventors: Felix Kramer, Vordemwald; Heinz Linder, Zofingen, both of (CH)

(73) Assignee: Grapha-Holding AG, Hergiswii (CH)

( * ) Notice: Subject to any disclaimer, the term of this patent is extended or adjusted under 35 U.S.C. 154(b) by 0 days.

(21) Appl. No.: 09/405,465

(22) Filed: Sep. 24, 1999

(30) Foreign Application Priority Data

Sep. 28, 1998 (EP) ..... 98810973

(51) Int. Cl.[7] ..... B65H 29/02
(52) U.S. Cl. ..... 271/204; 271/206; 270/52.19
(58) Field of Search ..... 271/204, 205, 271/206, 82, 85; 270/52.14, 52.16, 52.19; 198/470.1

(56) References Cited

U.S. PATENT DOCUMENTS

| | | | | |
|---|---|---|---|---|
| 3,877,564 | * | 4/1975 | Reist | 198/470.1 |
| 4,201,286 | * | 5/1980 | Meier | 271/206 X |
| 4,604,851 | * | 8/1986 | Reist | 271/204 X |
| 4,605,213 | * | 8/1986 | Hechler | 271/204 X |
| 4,893,805 | * | 1/1990 | Eberle | 271/204 |
| 5,007,624 | * | 4/1991 | Chandhoke | 271/204 X |
| 5,295,679 | * | 3/1994 | Reist | 271/204 X |
| 5,660,382 | * | 8/1997 | Meier | 271/206 X |
| 5,727,783 | * | 3/1998 | Tassinari | 271/204 X |
| 6,168,152 | * | 1/2001 | Ratz | 271/204 |

FOREIGN PATENT DOCUMENTS

| | | |
|---|---|---|
| 197 30 419 A1 | 2/1998 | (DE) . |
| 0329602 | 8/1989 | (EP) . |
| 0754642 | 1/1997 | (EP) . |
| 2338202 | 8/1977 | (FR) . |
| 9803419 | 1/1998 | (WO) . |
| 9825845 | 6/1998 | (WO) . |

* cited by examiner

*Primary Examiner*—Christopher P. Ellis
*Assistant Examiner*—Patrick Mackey
(74) *Attorney, Agent, or Firm*—Friedrich Kueffner

(57) ABSTRACT

A method and an apparatus for manufacturing printed products by insetting at least one subproduct and/or inserts into a main product, wherein at least the main products are grasped at the delivery of a printing machine by revolving gripping members of a conveying unit provided with an intermediate storage arrangement for inserting and delivering products, wherein the products are conveyed on conveying paths to an insetting machine formed of revolving insetting pockets, and wherein the products are taken up at the delivery of the printing machine by a first conveyor of the conveying unit connected to the insertion side of the intermediate storage arrangement and are transferred to a second conveyor of the conveying unit connected to the delivery side of the intermediate storage arrangement. The products grasped at the folds thereof are selectively transferred in front of the intermediate storage arrangement from the first conveyor with the folds facing forwardly on a direct transfer path to the second conveyor.

21 Claims, 5 Drawing Sheets

METHOD OF MANUFACTURING PRINTED PRODUCTS BY INSETTING AT LEAST ONE SUBPRODUCT INTO A MAIN PRODUCT AND APPARATUS FOR CARRYING OUT THE METHOD

BACKGROUND OF THE INVENTION

1. Field of the Invention

The present invention relates to a method of manufacturing printed products by insetting at least one subproduct and/or inserts into a main product, wherein at least the main products are grasped at the delivery of a printing machine by revolving gripping members of a conveying unit provided with an intermediate storage arrangement for inserting and delivering products, wherein the products are conveyed on conveying paths to an insetting machine formed of revolving insetting pockets, and wherein the products are taken up at the delivery of the printing machine by a first conveyor of the conveying unit connected to the insertion side of the intermediate storage arrangement and are transferred to a second conveyor of the conveying unit connected to the delivery side of the intermediate storage arrangement.

2. Description of the Related Art

The production quantity of a printing machine, for example, an offset rotation printing machine, is about 80,000 printed copies per hour which are taken up by conveying devices at the delivery for removal from the printing machine. The product quantity of between 40,000 and 80,000 copies per hour delivered by the printing machine has for a long time been processed by one or more insetting machines with the use of an intermediate storage arrangement.

This procedure requires processes which take a long time. In addition, the use of an intermediate storage arrangement makes it necessary that the printing sequence is uninterrupted, so that the product flow can be diverted to the intermediate storage arrangement when the operation of the insetting machine is interrupted.

For storing the products, winding rollers and similar units are used.

However, there is basically the desire to process the products without the use of the intermediate storage on winding rollers because in the winding rollers there is the tendency that the printed images are blurred as a result of the friction produced between the products when they are inserted and delivered.

SUMMARY OF THE INVENTION

Therefore, it is the primary object of the present invention to provide a method of the above-described type and an apparatus which make it possible to shorten the processing distances and to significantly reduce harmful steps resulting from intermediate storage and to reduce the investment costs.

In accordance with the present invention, the products grasped at the folds thereof are selectively transferred in front of the intermediate storage arrangement from the first conveyor with the folds facing forwardly on a direct transfer path to the second conveyor.

As a result of the method according to the present invention, a bypass is used which shortens the conveying paths between the printing machine and the insetting machine. Of course, this method also makes it possible to process subproducts or inserts in the same manner.

The method according to the present invention makes it possible to meet the requirements made of insetting machines and the products can be processed from the printing machine into the insetting machine without detours.

In accordance with an advantageous feature, the products taken up at the folds thereof at the delivery of the printing machine by the first conveyor are transferred also at the fold to the second conveyor leading into the insetting pockets of an insetting machine, so that handling of the products at the sensitive transfer locations is significantly simplified.

The transfer of the products from the first conveyor to the transfer path advantageously takes place in an inclined position extending approximately parallel to the transfer direction.

The apparatus for carrying out the method according to the present invention includes a conveying unit which picks up at least the main products by means of revolving gripping members at the delivery of a printing machine and transfers the products on a conveying path to revolving insetting pockets of an insetting machine, wherein the conveying unit includes an intermediate storage arrangement, and wherein a first conveyor connected to the intermediate storage arrangement at the insertion side thereof is provided for taking up the products at the delivery of the printing machine and a second conveyor of the conveying unit is provided at the delivery side of the intermediate storage arrangement for feeding the insetting pockets of the insetting machine.

In accordance with the present invention, the first conveyor is connected between the delivery and the intermediate storage arrangement to the second conveyor through a transfer unit which can be switched on and off, wherein the transfer unit is composed of clamps fastened to revolving traction means.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
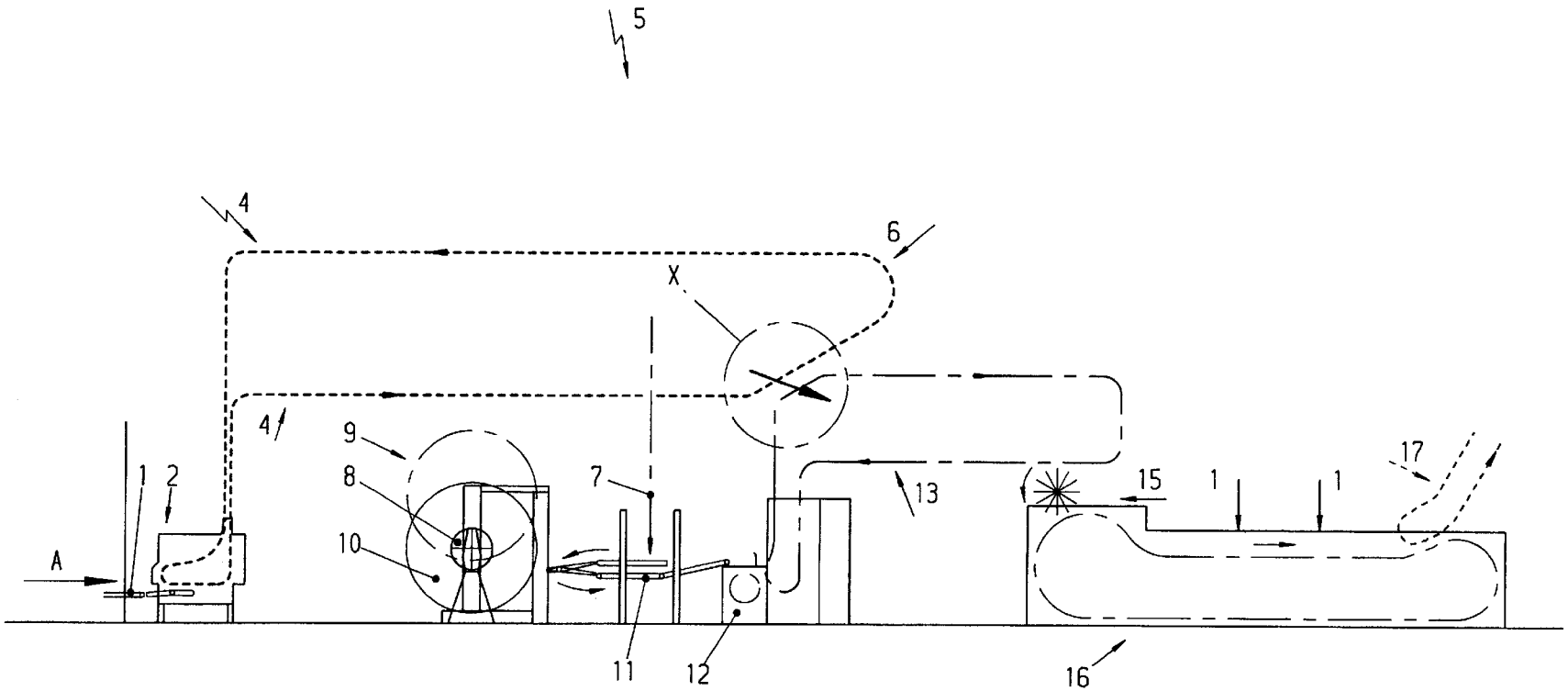
FIG. 1 is a schematic illustration of an apparatus for carrying out the method according to the present invention.

In FIG. 1 of the drawing, arrow A indicates the delivery of a printing machine, not shown, and the direction of the travel flow of the printed main products or subproducts 1. Arranged downstream of the delivery is a take-up station 2 at which the arriving products 1 are grasped at the fold thereof by gripping members 3, shown in FIG. 2, of a first conveyor 4 of a conveying unit 6 which supplies the apparatus 5 with products 1.

The products 1 grasped at the delivery A can be conveyed by the first conveyor 4 through a storage path 7 which branches off to a winding station 9 formed by a winding core 8, wherein the products are temporarily wound up into a winding 10 in the winding station 9. From the winding station 9, the products 1 are conveyed, for example, on conveyor belts 11 to a magazine of a feeder 12 illustrated in a simplified manner by a conveyor drum. The conveyor drum pulls the products 1 from the magazine located thereabove and transfers the products to a conveyor 13 indicated by dash-dot lines; the conveyor 13 is equipped with revolving gripping members 14 which grasp the products at the folds thereof.

The gripping members 14, whose conveying path is indicated by arrows, transfer the products 1 by means of a blade-type wheel into insetting pockets of an insetting machine 16 in which the printed products are completed by insetting additional subproducts 1 or inserts. A removal station 17 is located at the end of the feeding path of the insetting machine 16; the removal station 17 removes the finished printed products from the insetting pockets.

Apparatus 5 of the above-described type and such processing principles and systems are known in the art and are sold worldwide by Muller Martini and others.

Figure 2:
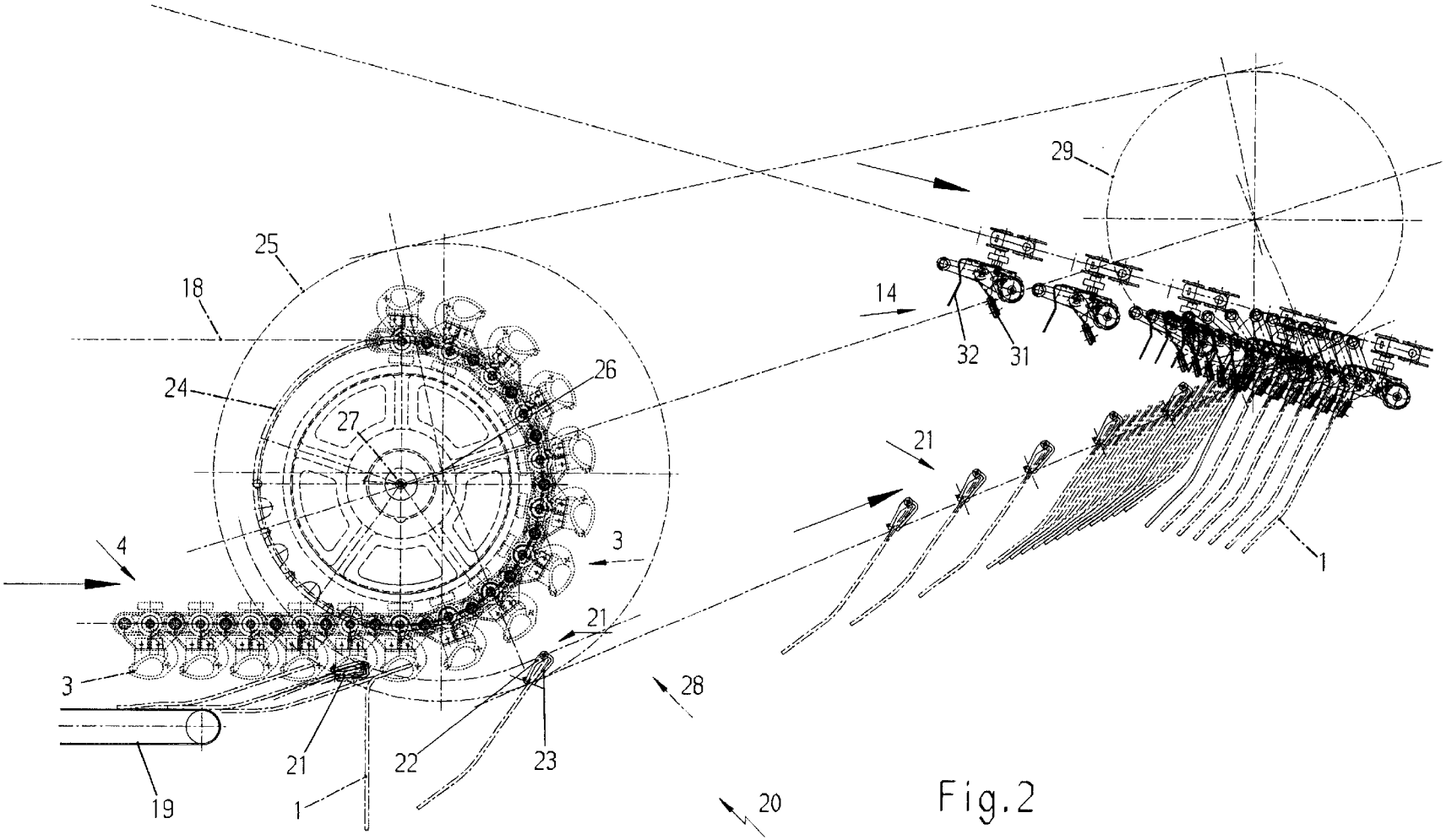
FIG. 2 is a schematic perspective illustration, on a larger scale, showing detail X of FIG. 1.
Figure 4:
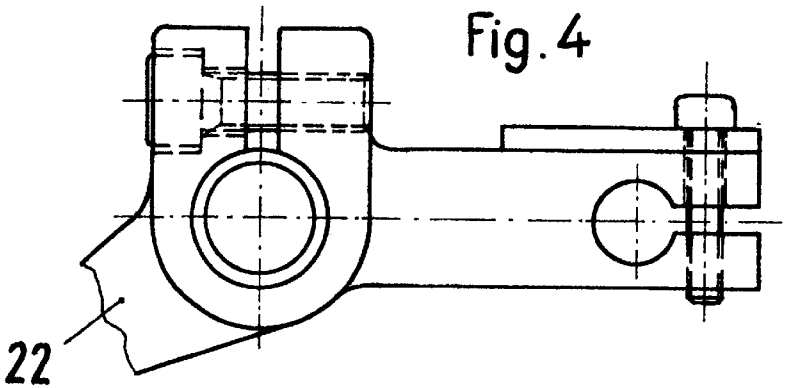
FIG. 4 is a view of a clamp arm 22 shown in FIG. 2.
Figure 5:
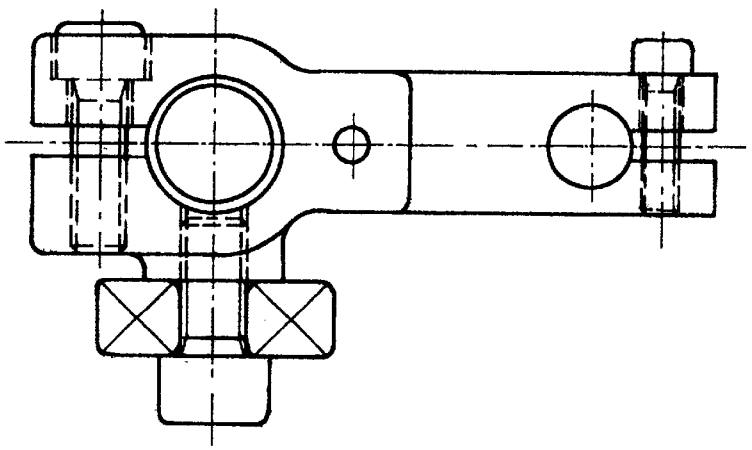
FIG. 5 is a side view of the device for laterally transferring one or more of the clamps 21 of the transfer unit 20.
Figure 3:
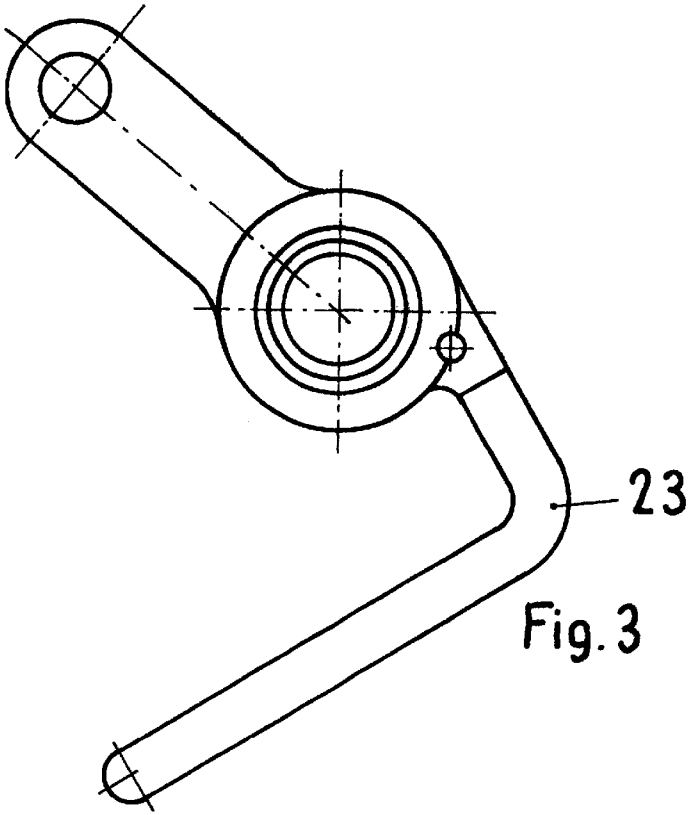
FIG. 3 is a view, on an even larger scale, of a moveable clamp arm 23 shown in FIG. 2.
Figure 6:
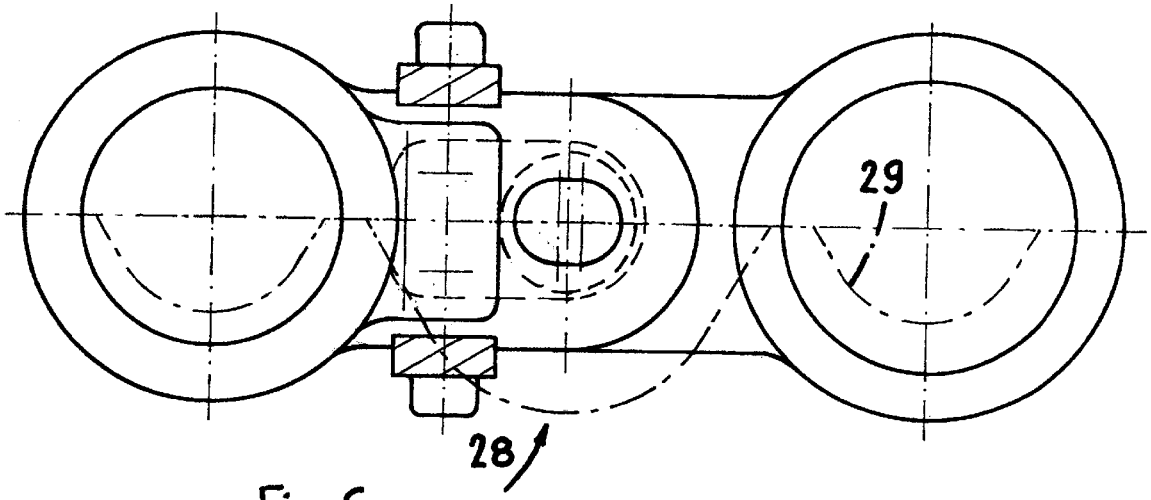
FIG. 6 is a side view of the link chain in the area of a guide roller 29 of the transfer unit 20.
Figure 8:
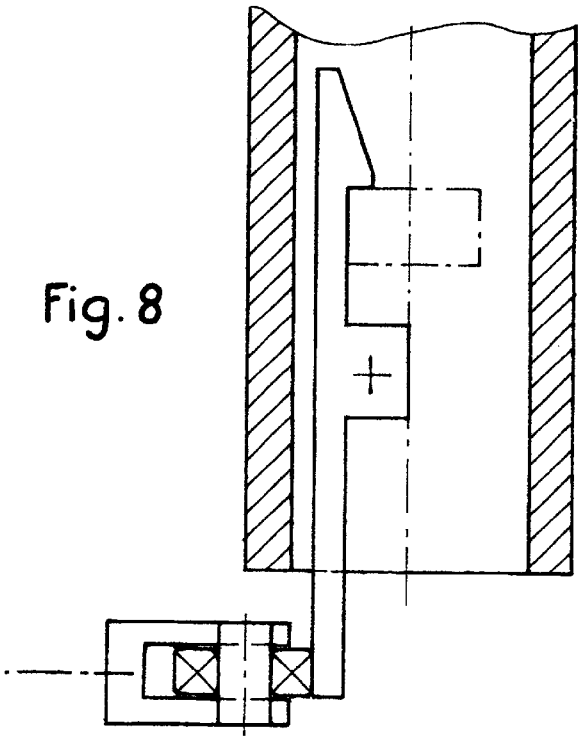
FIG. 8 is a partially sectional view of a device for locking a clamp 21 in the inoperative position.
Figure 7:
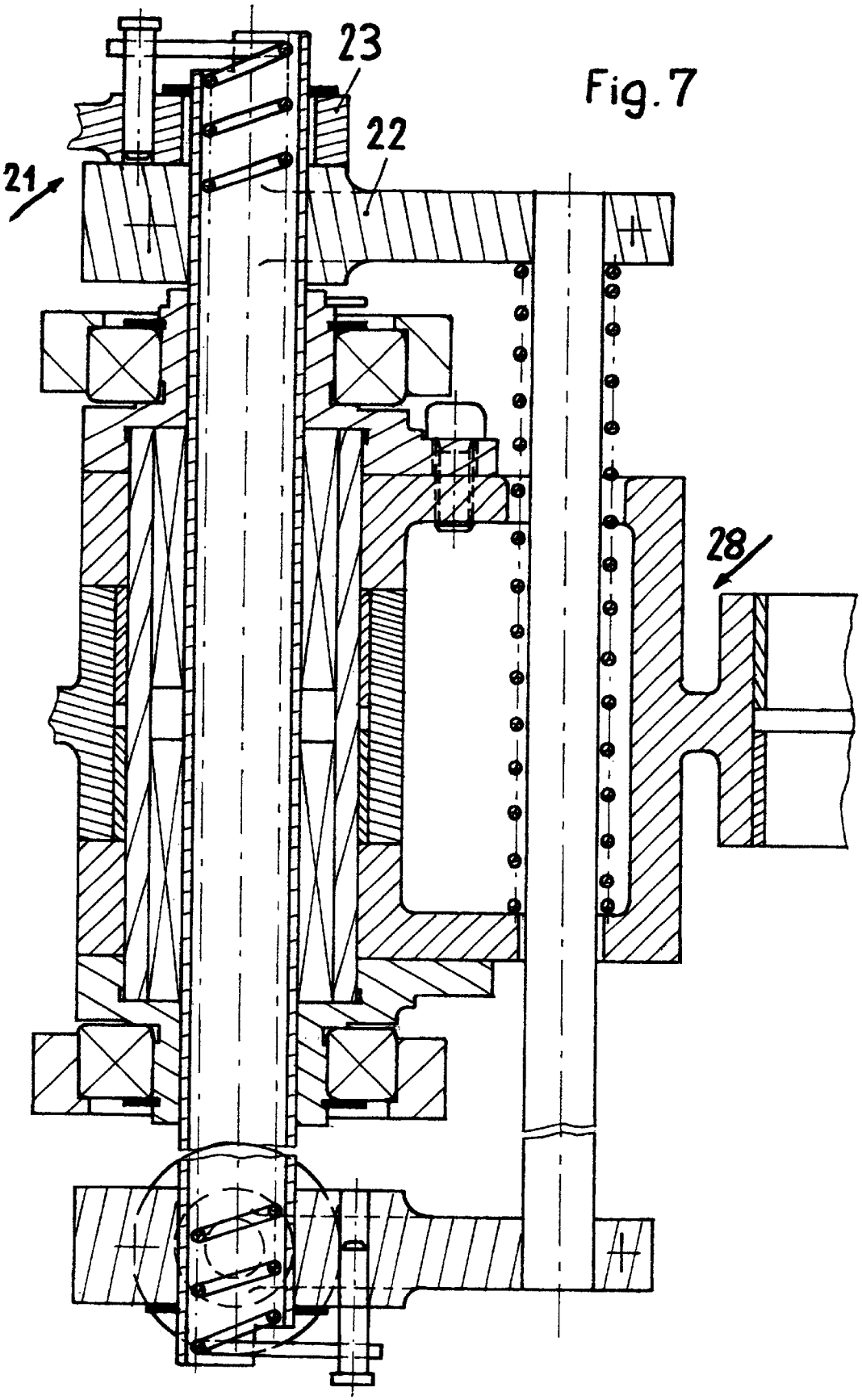
FIG. 7 is a partially sectional view of the device in FIG. 5.

FIG. 2 shows the detail of the apparatus 5 indicated by X in FIG. 1. This detail illustrates the possibility provided according to the construction of the present invention for transferring the products 1 from the delivery A of a printing machine to an insetting machine while avoiding an intermediate storage, i.e., feeding of the insetting machine on the shortest path.

FIG. 2 shows the first conveyor 4 connected to the delivery A in a transfer area of the apparatus 5 to be described in more detail below.

The first conveyor 4, shown in broken lines in FIG. 1, includes an endless traction means 18, shown in dash-dot lines in FIG. 2, for example, a link chain, wherein gripping members 3 are attached to the traction means 18 at regular intervals, for example, three inches; the gripping members 3 are aligned against their direction of movement, i.e., the products 1 are fed from behind to the open gripping members 3 fold first at a higher speed than that of the conveyor 4. This is a procedure known in the art. The gripping members 3 are open for a relatively short period of time when the products 1 are removed; this is why the gripping members 3 are shown in the closed state after the transfer area. When entering the transfer area, which is formed by the first conveyor 4 and a transfer unit 20 connected to the first conveyor 4 for conveying the products, the products 1 previously conveyed suspended at the fold are then conveyed at the free ends on a flat surface, i.e. lying on a conveyor belt in the illustrated embodiment, so that they assume a relatively stable position when being taken up by the transfer unit.

As illustrated in FIG. 2, the second to last of the products 1 has just been grasped by a clamp 21 of the transfer unit 20 and the gripping member 3 of the first conveyor 4 is still in the open position.

The product 1 which is still in the gripping member 3, and which as a result of its own weight has been swung from the dragged position into a suspended position, demonstrates that the illustrated embodiment carries out a partial removal, i.e., for example every second product 1 is conveyed from the first conveyor 4 to a remote processing station. As already mentioned, the total product quantity or a portion thereof, for example, 50% can be removed or transferred; also, it is possible to remove or transfer no product, for example, in the case the operation of the insetting machine is interrupted. In the illustrated embodiment, the opening mechanism of the conveying means with gripping members or clamps takes place mechanically through roller levers making contact with control cams. As shown, the clamp 21 of the transfer unit 20 assumes during the transfer approximately the direction of the gripping member 3, wherein the upper clamp arm 22 is not moveable, while the lower clamp arm 23 has an angular shape in order to be able to clamp in the clamp 21 the product 1 which when received by the clamp rests against the upper clamp arm 22 in the end position.

In the transfer area of the products 1 to the transfer unit 20, the gripping members 3 are deflected about a chain wheel 24 in the opposite direction, while the clamps 23 are deflected about a larger guide wheel 25 into the opposite direction. The travel path of the clamps 21 and the path of the gripping members 3 of the first conveyor 4 intersect in the transfer area, and the clamps 21 have during the transfer at least approximately the same speed as the gripping members 3. Simultaneously, the distance between the clamps 21 is selected greater than that between the gripping members 3 at the first conveyor 4.

Moreover, the axis 26 of the guide wheel 25 is arranged at an angle laterally offset relative to the axis of rotation 27 of the guide wheel 24 of the gripping members 3; this is due to an optimization of the position and the operation of the gripping member 3 and the clamps 21 during the transfer of the products 1.

Concerning the changeable position of the clamp arm 23 which is controlled so as to be moveable about a horizontal axis, it should be added that when the transfer area is reached, the angle-shaped end extends approximately perpendicularly in front of and in the travel path of the fold of a product 1 supplied by the corresponding gripping member 3 of the first conveyor 4 and the angle-shaped end moves underneath the product 1 successively in the opposite direction until it impinges in a clamping manner against the edge of the product 1. The clamp 21 may be held closed, for example, by the force of a spring.

Since the products 1 are grasped by the gripping members 3 of the first conveyor 4 in the middle of the fold, the clamps 21 of the transfer unit 20 act on the products 1 on both sides of the gripping members 3. For this purpose, the transfer unit 20 is formed by two parallel revolving clamp chains 28.

If no transfer or only a partial transfer to the second conveyor 13 takes place, the clamps 22 are not used or switched off; this can be effected, for example, by a control roller connected to a clamp 21 which laterally moves the clamp 21 against the force of the spring out of the range of operation of the clamp 21.

The transfer unit 20 extends preferably at an angle relative to the conveying direction, for example, an angle of 15 to 25°, so that a flat transfer is created between the transfer unit 20 and the conveyor even in the remote delivery or take-up area.

The delivery end of the transfer unit 20, which intersects the travel path of the second conveyor 13, is located in or in front of the lower conveying area of the parallel lower portion of the traction means of the transfer unit 20 which travels around guide rollers 29.

The conveying directions of the transfer unit 20 and the second conveyor 13 extend in the delivery and take-up area at an acute angle relative to each other, for example, about 400, and the trailing gripping member part 32 of the gripping members 14 corresponding to the moveable gripping member part 31 and the trailing clamp arm 22 of the clamp 21 of the transfer unit 20 corresponding to the moveable clamping arm 23 form a common clamping plane in the delivery and take-up area.

The configuration of the transfer unit 20 and the interaction thereof with the first conveyor 4 and the second conveyor 13 make possible a precisely timed switching to the desired product quantity or an interruption of the transfer; this is particularly important when the products 1 are continuously supplied from the delivery of the printing machine.

The invention is not limited by the embodiments described above which are presented as examples only but can be modified in various ways within the scope of protection defined by the appended patent claims.

We claim:

1. A method of manufacturing printed products by insetting at least one subproduct and/or inserts into a main product, the method comprising grasping at least the main products at a delivery of a printing machine by revolving gripping members of a conveying unit provided with an intermediate storage arrangement for inserting and delivering products, conveying the products on conveying paths to an insetting machine formed of revolving insetting pockets, and taking up the products at the delivery of the printing machine by a first conveyor of the conveying unit connected to an insertion side of the intermediate storage arrangement and transferring the products to a second conveyor of the conveying unit connected to a delivery side of the intermediate storage arrangement, the method further comprising selectively transferring the products grasped at folds thereof in front of the intermediate storage arrangement from the first conveyor with the folds facing forwardly on a direct transfer path to the second conveyor.

2. The method according to claim 1, wherein the products taken up at the delivery of the printing machine at the folds thereof are grasped at the folds thereof when transferred to the second conveyor.

3. The method according to claim 1, comprising transferring the products form the first conveyor to the direct transfer path in an approximately parallel inclined position.

4. An apparatus for manufacturing printed products by insetting at least one subproduct and/or inserts into a main product, the apparatus comprising a conveying unit with revolving gripping members for picking up at least the main products at a delivery of a printing machine and for transferring the products on a conveying path to revolving insetting pockets of an insetting machine, the conveying unit comprising an intermediate storage arrangement having an insertion side and a delivery side, a first conveyor connected to the insertion side of the intermediate storage arrangement for taking up the products at the delivery of the printing machine and a second conveyor at the delivery side of the intermediate storage arrangement for feeding the insetting pockets of the insetting machine, the apparatus further comprising a transfer unit which can be switched on and off for connecting the first conveyor between the delivery of the printing machine and the intermediate storage arrangement to the second conveyor, and wherein the transfer unit is comprised of clamps fastened to revolving traction means.

5. The apparatus according to claim 4, wherein the gripping members of the conveying unit and the clamps of the transfer unit have in a common transfer area of the products a direction of movement approximately in the same direction and an open position extending opposite a conveying direction of the products.

6. The apparatus according to claim 5, wherein a path of the gripping members of the first conveyor and a path of the clamps of the transfer units intersect in a lower portion of the transfer unit in the transfer area of the products, and wherein the paths of the gripping members and of the clamps extend further in opposite directions.

7. The apparatus according to claim 6, further comprising guide wheels for deflecting the paths.

8. The apparatus according to claim 6, wherein the clamps of the transfer unit are arranged laterally offset relative to the gripping members of the first conveyor.

9. The apparatus according to claim 4, wherein the transfer unit is configured for removing at least one partial quantity or no products of a quantity of products supplied by the printing machine.

10. The apparatus according to claim 4, further comprising a control device for rendering inoperative certain clamps for effecting a partial transfer of the products or for interrupting the transfer of the products.

11. The apparatus according to claim 8, wherein each clamp comprises a clamp arm moveable by control means against a spring force.

12. The apparatus according to claim 11, wherein the moveable clamp arm is configured so as to be pivotable about a horizontal axis.

13. The apparatus according to claim 7, wherein, in the transfer area, the guide wheel of the first conveyor has a smaller diameter than the guide wheel of the transfer unit.

14. The apparatus according to claim 13, wherein axes of rotation of the guide wheels of the first conveyor and the transfer unit are arranged eccentrically relative to each other.

15. The apparatus according to claim 13, wherein a distance between the clamps at the traction means of the transfer unit is greater than a distance between the gripping members of the first conveyor.

16. The apparatus according to claim 4, wherein the transfer unit is comprised of traction means revolving on paths of guide rollers mounted on spaced-apart horizontal axes.

17. The apparatus according to claim 4, wherein a transfer area between the transfer unit and the second conveyor is formed by a lower portion of the traction means for conveying the products and the second conveyor which intersects the lower portion at an acute angle.

18. The apparatus according to claim 17, wherein the transfer area is located at an end of the lower portion of the transfer unit.

19. The apparatus according to claim 17, wherein each gripping member of the second conveyor has a controllable moveable gripping component and an immoveable gripping component, and wherein each clamp of the transfer unit has a controllable moveable clamp arm and an immoveable clamp arm, and wherein the immoveable gripping components and the immoveable clamping arms form in the transfer area of the products a common clamping plane.

20. The apparatus according to claim 4, wherein the gripping members of the second conveyor have a greater distance between each other than the clamps of the transfer unit, and wherein the gripping members are moved at a greater speed than the clamps.

21. The apparatus according to claim 17, wherein the transfer unit and the second conveyor are connected through a drive and the speed of the transfer unit and the second conveyor is adjustable relative to the speed of the first conveyor.

* * * * *